US005671693A

United States Patent [19]

Robinson

[11] Patent Number: 5,671,693

[45] Date of Patent: Sep. 30, 1997

[54] PONTOON BOAT MOORING SYSTEM

[75] Inventor: Mark D. Robinson, Wheeling, W. Va.

[73] Assignee: The Louis Berkman Company, Steubenville, Ohio

[21] Appl. No.: 658,164

[22] Filed: Jun. 4, 1996

[51] Int. Cl.[6] ..... B63B 21/00

[52] U.S. Cl. ..... 114/230

[58] Field of Search ..... 114/230, 231, 114/362, 242, 249, 250, 61

[56] References Cited

U.S. PATENT DOCUMENTS

D. 331,137 11/1992 DeLaura ..... D34/32

1,534,593 4/1925 King ..... 114/61

2,433,858 1/1948 Maxson ..... 114/230

3,081,731 3/1963 McEvoy ..... 114/230

*Primary Examiner*—Jesus D. Sotelo

*Attorney, Agent, or Firm*—Vickers, Daniels & Young

[57] ABSTRACT

A pontoon boat mooring system is provided which comprises first and second rigid spacing members pivotably mounted in a spaced-apart relation at the edge of a dock. One or both of the spacing members may also be mounted for lateral movement relative to the dock to allow for use with boats of different widths. In use the spacing members are pivoted toward the mooring eyes on the forward portions of the pontoons and connected thereto by a pin which passes through two parallel portions of the spacing members and the mooring eye.

45 Claims, 6 Drawing Sheets

PONTOON BOAT MOORING SYSTEM

The present invention is directed toward a system for connecting a boat to another object and, more particularly, toward a system for mooring a pontoon boat to a dock.

BACKGROUND OF THE INVENTION

Pontoon boats are a popular form of recreational transportation, especially on calm, inland bodies of water. They are formed from a pair of spaced apart, hollow pontoons which are connected by a frame mounted to the top portions of each pontoon. The frame supports a deck and optional features such as a railing and seats. Small versions may include a paddle wheel and pedals and be powered by the pedaling of the boat's passengers. Larger versions use an outboard motor for power. These boats are exceptionally stable and are often used for fishing or family excursions.

Because pontoon boats are relatively lightweight and flexible, they can be difficult to moor. The frame of such boats is not sturdy and does not provide a good attachment point for a mooring line. Furthermore, the pontoons can easily puncture if they rub against or strike a dock and such contact can also be damaging to docks. Moreover, the pontoons are disposed beneath the frame making it difficult to attach a mooring line to the side of a pontoon. Mooring a pontoon boat alongside a dock in the same manner as a non-pontoon boat would likely damage the pontoons, frame and dock if the boat were subjected to any wind or waves.

For these reasons, pontoon boats are generally provided with mooring eyes on the front or rear portion of each pontoon and attached to a main dock by tying ropes from the dock to the mooring eyes. An auxiliary or "finger" dock extends perpendicularly from the main dock alongside the pontoon boat to allow for easy boarding. The mooring eyes provide solid attachment points for the mooring lines but the ropes do not preclude contact between the boat and the main dock or the finger dock or docks at the side of the boat. In this respect, the from portions of the pontoons can impact against and/or rub against the dock when the boat drifts forwardly, and the sides of the boat or the pontoons can strike the finger docks as the boat drifts from side to side. It is therefore desirable to provide a system which can be quickly and easily installed on a dock and which is operable for securing a pontoon boat to a main dock in a manner which prevents damage to either the boat or the dock.

SUMMARY OF THE INVENTION

The present invention overcomes these and other problems by providing a mooring system which includes a pair of dock-mounted, spaced apart connectors or spacers, each of which includes a portion which can be connected to one of the pontoons of a pontoon boat. The spacers are rigid and connected between the pontoons and a stationary dock to limit movement of the boat in the plane of the surface of the water while allowing the boat to rise and fall with passing waves and tide changes. The connectors are lightweight, easy to install and use, and in stabilizing a boat against movement in the plane of the surface of the water, provide a mooring system which avoids the problems referred to above and which exist in connection with prior pontoon boat mooring systems.

In accordance with the present invention, a system comprises first and second dock-mounted spacers for attaching the pontoons of a pontoon boat to a dock. In one embodiment, each of the spacers comprises a dock-mounted portion which includes a pair of spaced-apart bosses extending therefrom and a rigid frame pivotably attached to the bosses. The end of the frame adjacent the dock can move laterally relative to the bosses, and the end of the frame furthest from the dock includes a finger portion for attachment to one pontoon of a pontoon boat. The pontoon is fastened to this frame such as by use of a pin which passes through the finger portion and a part on the one pontoon, such as a mooring eye. Thus, when the boat moves in a vertical plane, the frames of the two spacers are free to pivot both at the dock and at the pontoon attachment point, but forward, backward and sideways movement is limited by the rigid nature of the frames.

In a second embodiment, each of the spacers comprises a dock-mounted portion having a pair of spaced-apart journal plates extending therefrom. The journal plates support a rod therebetween and a first pipe is mounted over the rod between the journal plates for rotation relative to the rod. The pipe does not span the entire distance between the journal plates, and this allows the pipe to move laterally with respect to the dock. A second pipe is connected to a central part of the first pipe and extends away from the first pipe at a 90 degree angle. A finger portion is mounted on the end of the second pipe furthest from the dock for attachment to one pontoon of a pontoon boat in the same manner as in the first embodiment. Both the first and second embodiments beneficially allow for lateral adjustability with respect to mounting the spacers on a dock to allow for greater tolerances in the placement of the dock-mounted portions.

In a third embodiment, the distance between the journal plates of the second embodiment is increased and the rod is lengthened to allow for lateral adjustability after mounting the spacer on a dock to accommodate boats having pontoons spaced apart different distances. In this embodiment, the rod includes openings for receiving stops to position the pipe laterally of the rod in a desired adjusted position.

In a fourth embodiment, a pair of spacers comprises one spacer according to the third embodiment and one spacer according to either the first or second embodiment to allow for adjustability while at the same time keeping the attachment point for one of the pontoons relatively fixed.

In a fifth embodiment, the spacer includes a telescoping central portion to allow the distance between a dock and a pontoon boat to be varied to accommodate boats of different sizes or to accommodate various water levels at dock side.

It is therefore a principal object of the present invention to provide a pontoon boat mooring system which allows a pontoon boat to be securely moored to a dock without damaging the pontoon boat or the dock.

It is a further object of the present invention to provide a pontoon boat mooring system which allows a moored pontoon boat to rise and fall with the surface of the water while preventing lateral and longitudinal movement of the boat relative to a dock.

It is another object of the present invention to provide a pontoon boat mooring system which can be quickly and easily mounted on a dock and attached to a pontoon boat.

It is still a further object of the present invention to provide a pontoon boat mooring system which is adjustable to allow for the mooring of pontoon boats of different widths.

It is yet another object of the present invention to provide a pontoon boat mooring system which is compact and does not occupy significant space on a dock.

It is yet a further object of the present invention to provide a pontoon boat mooring system which can be attached to a horizontal and/or a vertical surface of a dock.

It is still a further object of the present invention to provide a pontoon boat mooring system having a minimal number of parts which can be sold in kit form and easily assembled by a consumer.

It is another object of the present invention to provide a pontoon boat mooring system which can be adjusted to accommodate pontoon boats of different sizes.

It is still another object of the present invention to provide a pontoon boat mooring system which can be adjusted to accommodate different water levels relative to a dock.

BRIEF DESCRIPTION OF THE DRAWINGS

These and other objects of the subject invention will be better understood by a reading and understanding of the detailed description of the invention in connection with the following drawings of which.

DETAILED DESCRIPTION OF PREFERRED EMBODIMENTS

Figure 1:
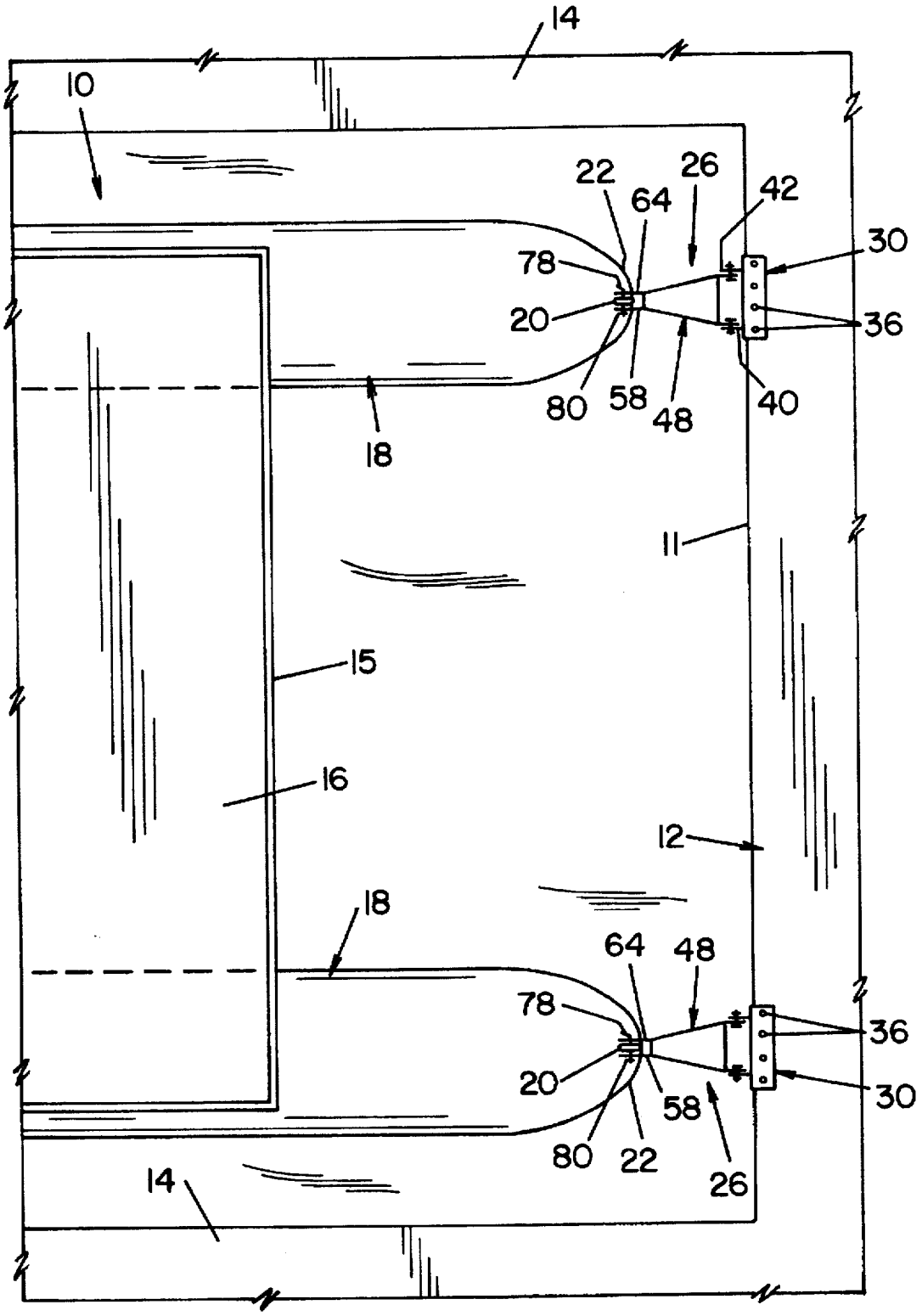
FIG. 1 is a plan view of a pontoon boat moored to a dock using a mooring system according to the present invention.

Referring now to the drawings, wherein the showings are for purposes of illustrating preferred embodiments of the subject invention only and not for purposes of limiting same, FIG. 1 shows a top view of a pontoon boat 10 moored to a main dock 12 and between two finger docks 14. Pontoon boat 10 comprises a frame 15 supporting a deck 16 mounted atop a pair of pontoons 18, each of which pontoons includes a mooring eye 20 at the front end 22 thereof. The mooring system of the subject invention comprises first and second spaced-apart mooring spacers 26 which are secured to main dock 12 and to mooring eyes 20 to hold boat 10 in place. As will be better understood when the specific structure of the mooring frames is described hereinafter, the present mooring system allows boat 10 to move vertically up and down between finger docks 14 while limiting lateral movement of the boat between the finger docks 14 and preventing movement toward and away from main dock 12.

Figure 2:
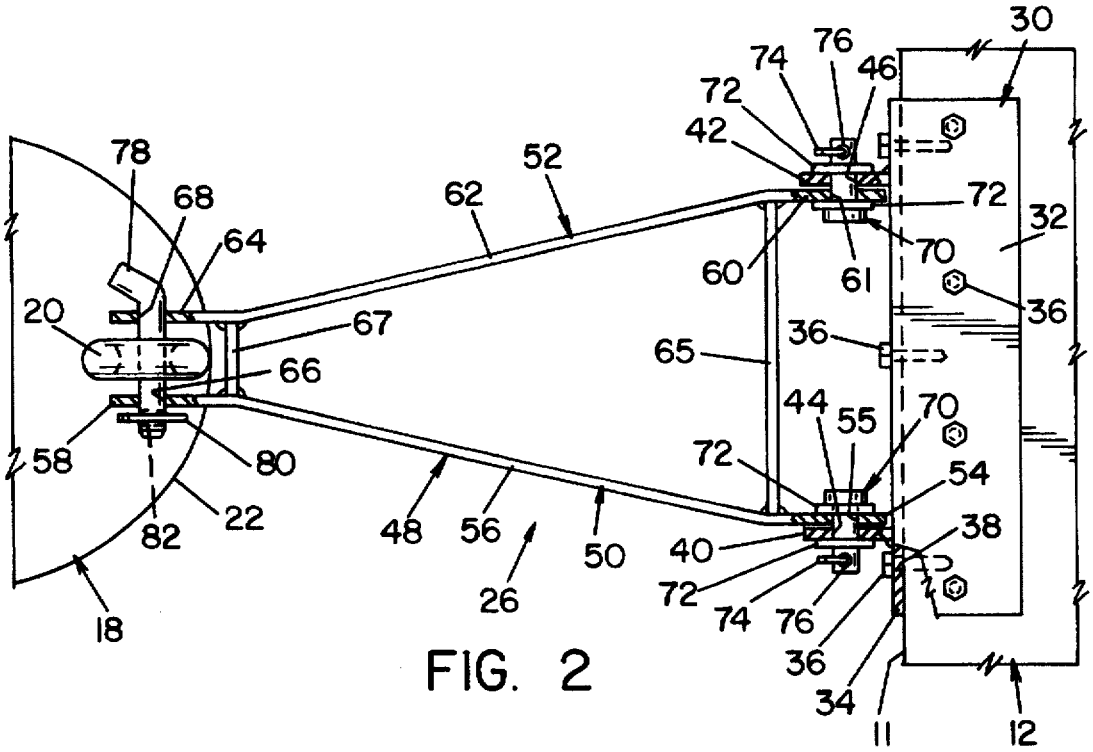
FIG. 2 is a plan view of one embodiment of spacers for the mooring system shown in FIG. 1.
Figure 3:
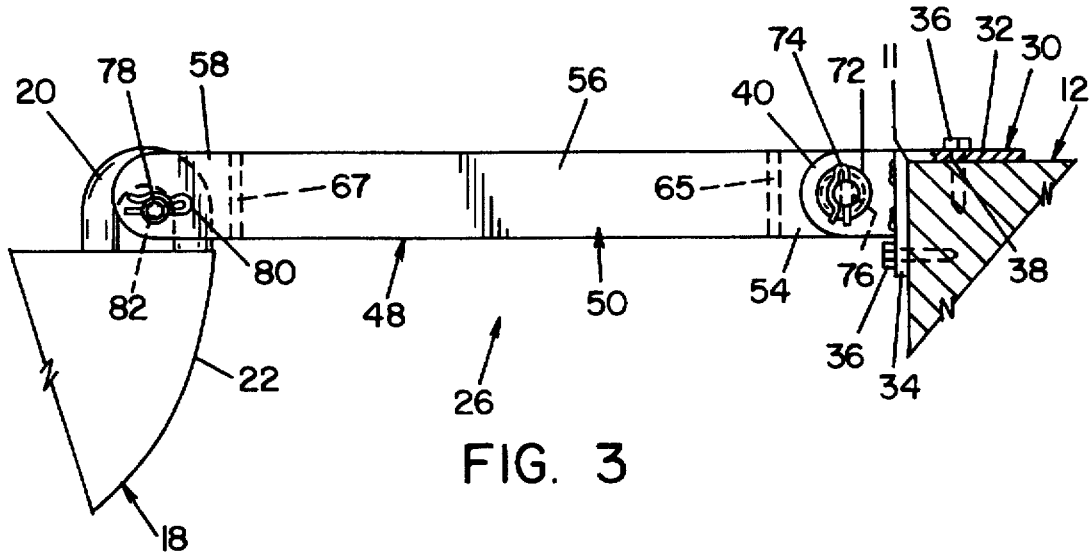
FIG. 3 is a side elevational view of the spacer shown in FIG. 2.

In a first embodiment, the mooring system comprises a pair of spacers 26 as seen in FIGS. 2 and 3. These mooring spacers 26 each comprise an angle iron 30 mounted over the edge 11 of dock 12 and having a horizontal plate portion 32 and a vertical plate portion 34. Angle iron 30 is preferably 8 to 12 inches long and made from 3/16 inch steel. Alternatively, two separate four inch angle irons could be mounted on the dock and spaced such that the ends thereof are about 8 to 12 inches apart. Angle iron 30 is secured to dock 12 by a plurality of lag bolts 36 which pass through openings 38 in horizontal plate portion 32 and vertical plate portion 34 and into dock 12. First and second bosses 40 and 42 extend from vertical plate portion 34 at right angles to the latter and parallel to one another. The bosses are separated by approximately six to eight inches. Bosses 40 and 42, respectively, include circular openings 44 and 46 therethrough spaced apart from plate portion 34. Mooring spacers 26 further comprise a generally A-shaped frame 48 having a first side rail 50 and a second side rail 52 which serve to space boat 10 approximately 12 to 16 inches from dock 12. First side rail 50 includes a leg portion 54 having an opening 55, a central portion 56, and a terminal finger portion 58, while second side rail 52 includes a leg portion 60 having an opening 61, a central portion 62, and a terminal finger portion 64. Leg portions 54 and 60 are generally parallel to one another and separated by approximately six to eight inches. Finger portions 58 and 64 are also parallel to the leg portions and to one another and are separated by a distance of 1½ to 2 inches. Central portions 56 and 62 converge toward one another outwardly from dock 12 and extend from the leg portions to the finger portions. Terminal finger 58 includes an opening 66 therethrough which is aligned with an opening 68 in terminal finger 64. A first transverse brace 65 extends between leg 54 and leg 60 and a second transverse brace 67 connects terminal finger portion 58 to terminal finger portion 64. The side rails and braces are preferably formed from lengths of steel 3/16 inch thick and 2 inches wide. This confers substantial rigidity to the frame in the direction of the width of the side rails and in the direction normal to the width direction.

Frame 48 is connected to dock-mounted angle iron 30 by placing legs 54 and 60 of frame 48 adjacent to bosses 40 and 42, respectively, and aligning the openings in the legs with the openings in the bosses. Pins 70 are passed through the aligned openings and are secured in place together with washers 72 by spring clip pins 74 which extend through openings 76 in the pins 70. Accordingly, it will be appreciated that pins 70 pivotally attach the frame to the bosses. Finger portions 58 and 64 and pins 78 and 80 shown in FIG. 2 are used in fastening spacer 26 to pontoon 18 as set forth more fully hereinafter.

Figure 4:
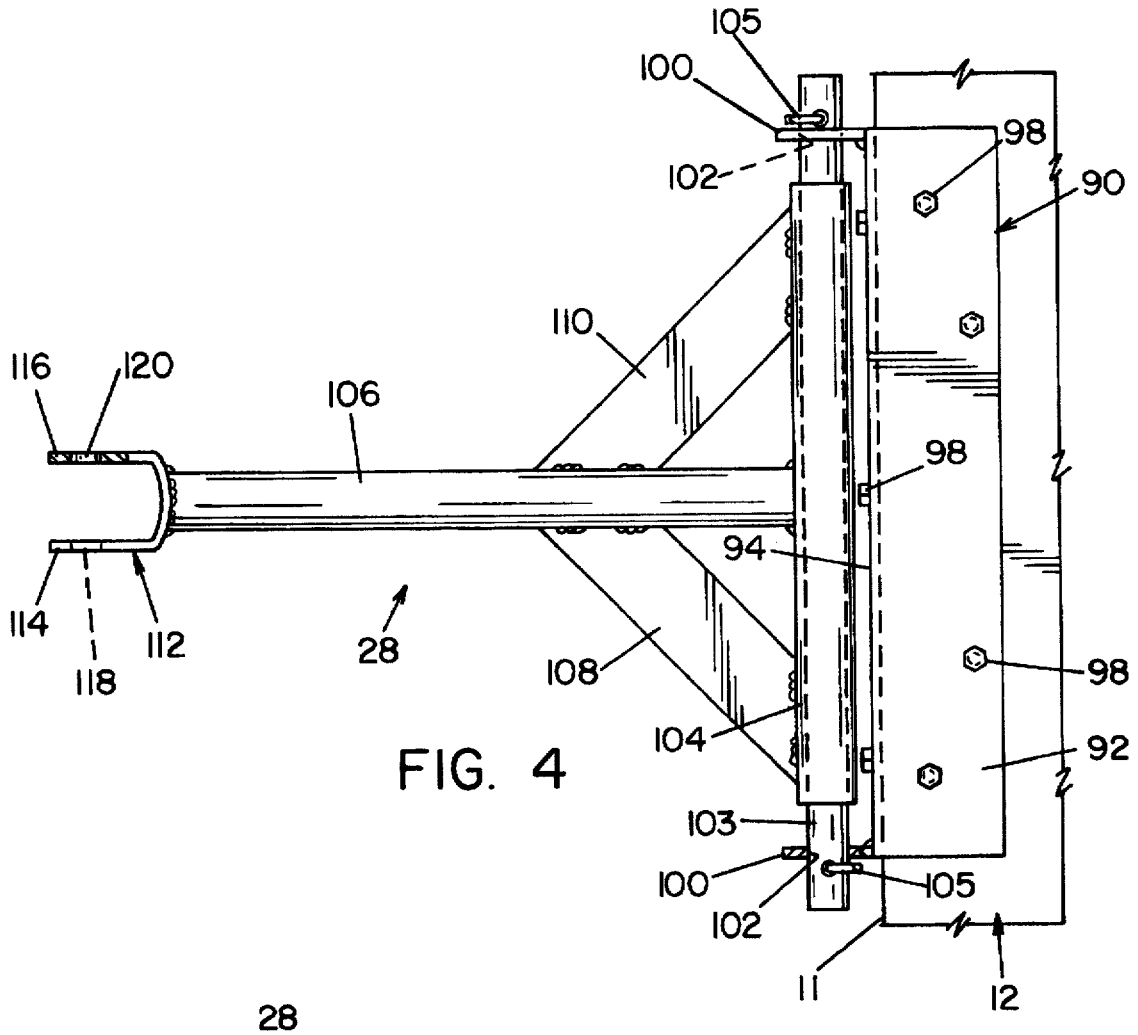
FIG. 4 is a plan view of another embodiment of spacers for use in the mooring system shown in FIG. 1.
Figure 5:
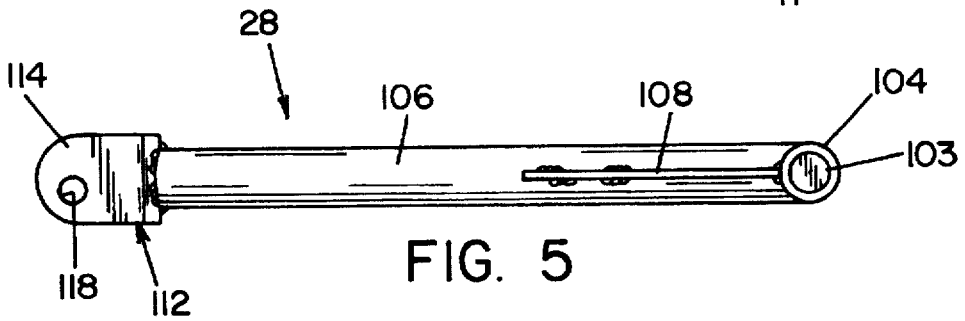
FIG. 5 is a side elevational view of the spacer shown in FIG. 4.
Figure 6:
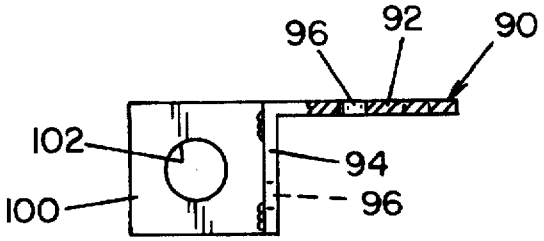
FIG. 6 is a side elevational view of a mounting member for use in connection with the spacer shown in FIGS. 4 and 5; and, FIG. 7 is a plan view illustrating a modification of the spacer shown in FIGS. 4–5.

In a second embodiment, the mooring system comprises a pair of mooring spacers 28 shown in FIGS. 4–6. As seen in FIGS. 4 and 6, mooring spacers 28 include a dock-mounted angle iron 90 mounted over edge 11 of dock 12 and having a horizontal plate portion 92 and a vertical plate portion 94. Plate portions 92 and 94 include a plurality of holes 96 for receiving a plurality of lag bolts 98 for fastening mounting plate 90 to dock 12. Two journal plates 100 having circular central openings 102 therethrough extend perpendicularly from vertical plate portion 94. Alternatively, two angle irons 90 could be mounted on dock 12, one to support each of journal plates 100. Spacers 28 further include a rod member 103 made from ⅞ inch steel bar stock supported for rotation in openings 102 in the journal plates 100 about an axis parallel to the edge of dock 12. Rod 103 extends outwardly of both journal beatings and is retained in place relative thereto by spring clip end pins 105. A first tubular member 104 is mounted on rod 103 between the journal plates for rotation relative thereto. Tubular member 104 is approximately ⅝ inch shorter than the distance between the journal plates and can move relative to rod 103 laterally between the plates. This advantageously provides tolerance with respect to mounting the spacer on a dock in connection with mooring a boat having a given pontoon spacing. First tubular member 104 is preferably formed from a pipe having a 1 5/16 inch outside diameter and a ⅛ inch wall thickness. A second tubular member 106 is connected to first tubular member 104 at a 90° angle. Member 106 is preferably a pipe having the same cross-sectional dimensions as that of first tubular member 104. A first brace 108 is mounted at approximately a 45° angle between first tubular member 104 and second tubular member 106 while a second brace 110 similarly extends between first tubular member 104 and the opposite side of second tubular member 106. A U-shaped connector 112 having legs 114 and 116 is attached to the end of second tubular member 106 spaced from first tubular member 104. Legs 114 and 116 include aligned openings 118 and 120 respectively, for the purpose set forth hereinafter.

Figure 7:
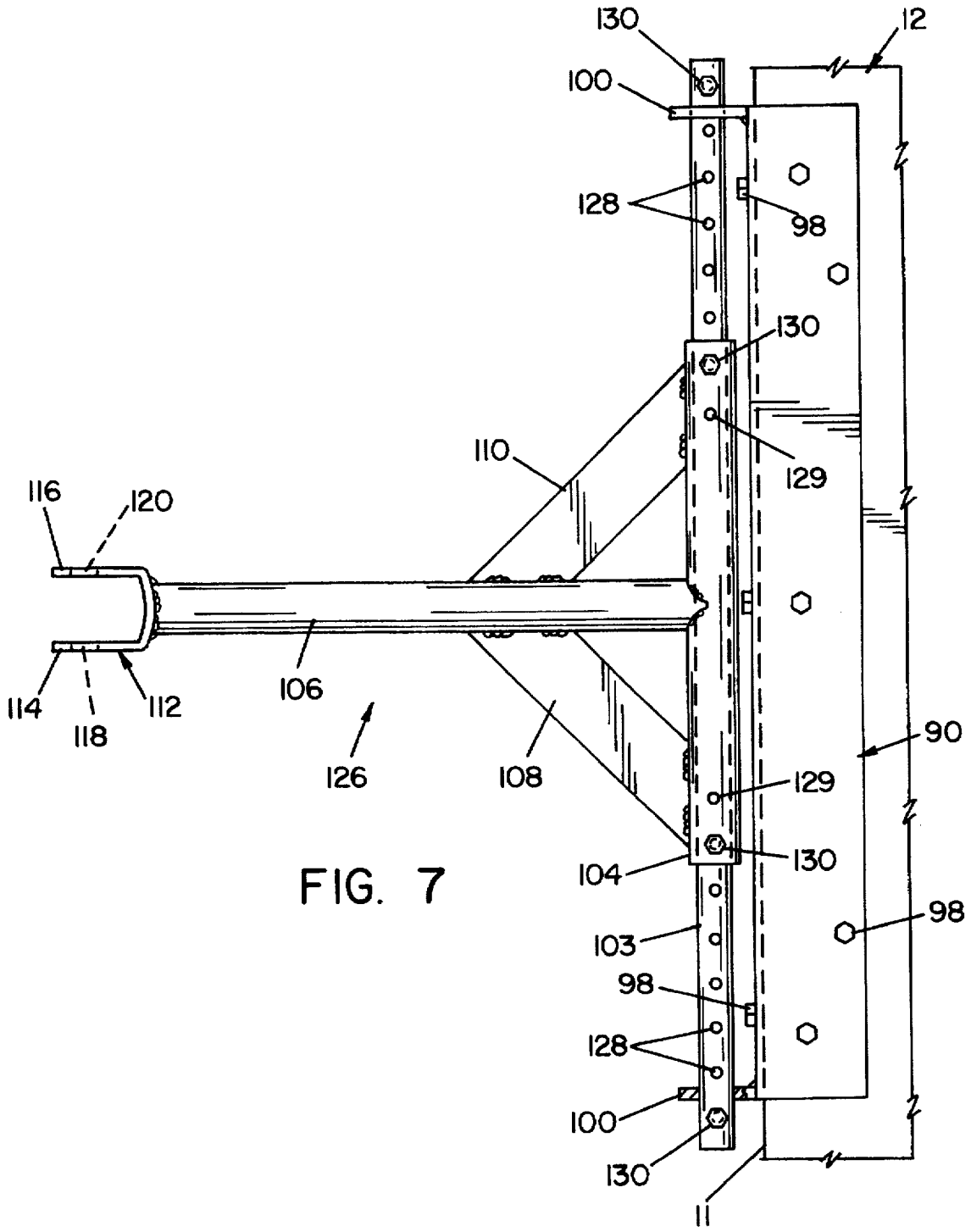
Figure 8:
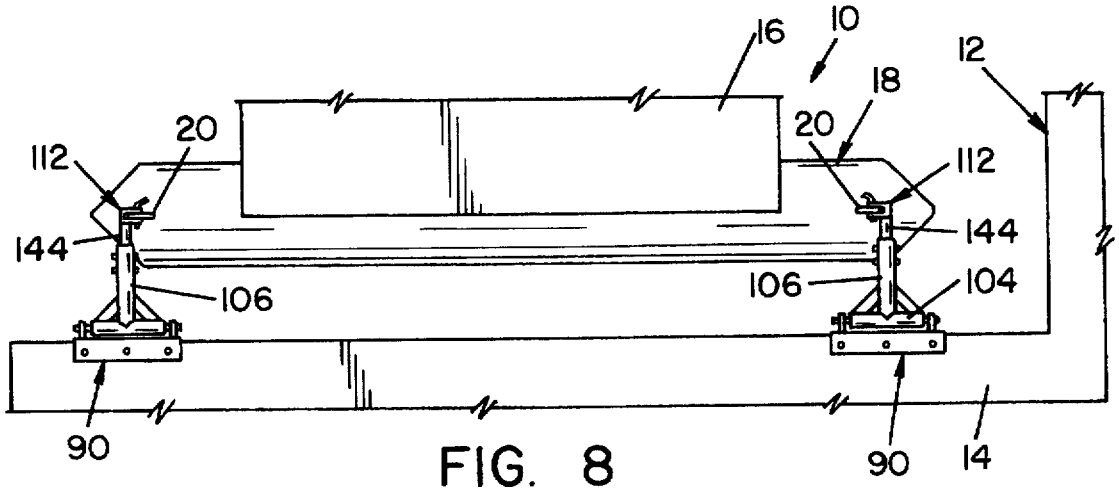
FIG. 8 is a plan view showing a modification of the spacers shown in FIG. 4 and a manner of positioning the spacers.
Figure 9:
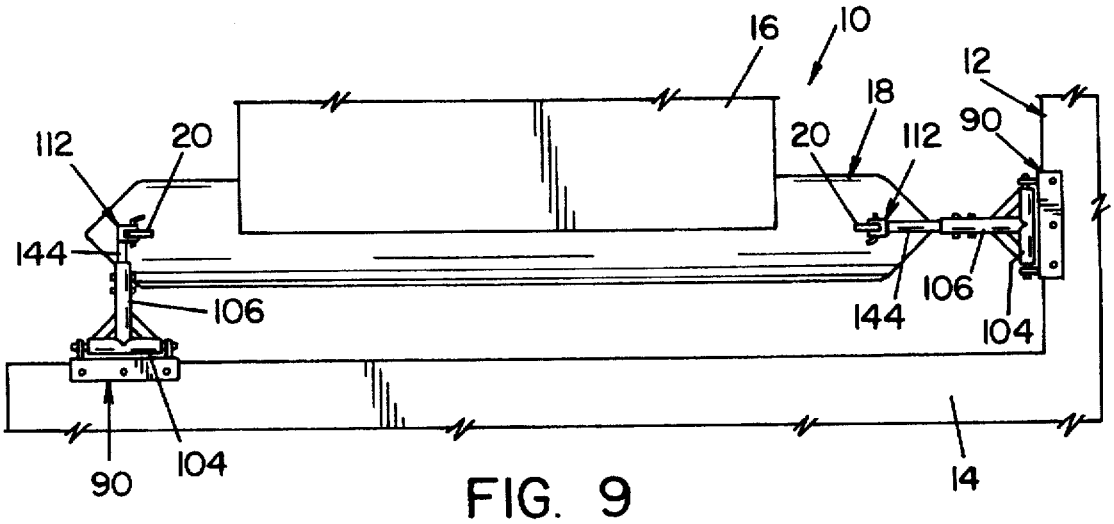
FIG. 9 is a plan view showing the use of a spacer as shown in FIG. 8 together with a spacer as shown in FIG. 4.
Figure 10:
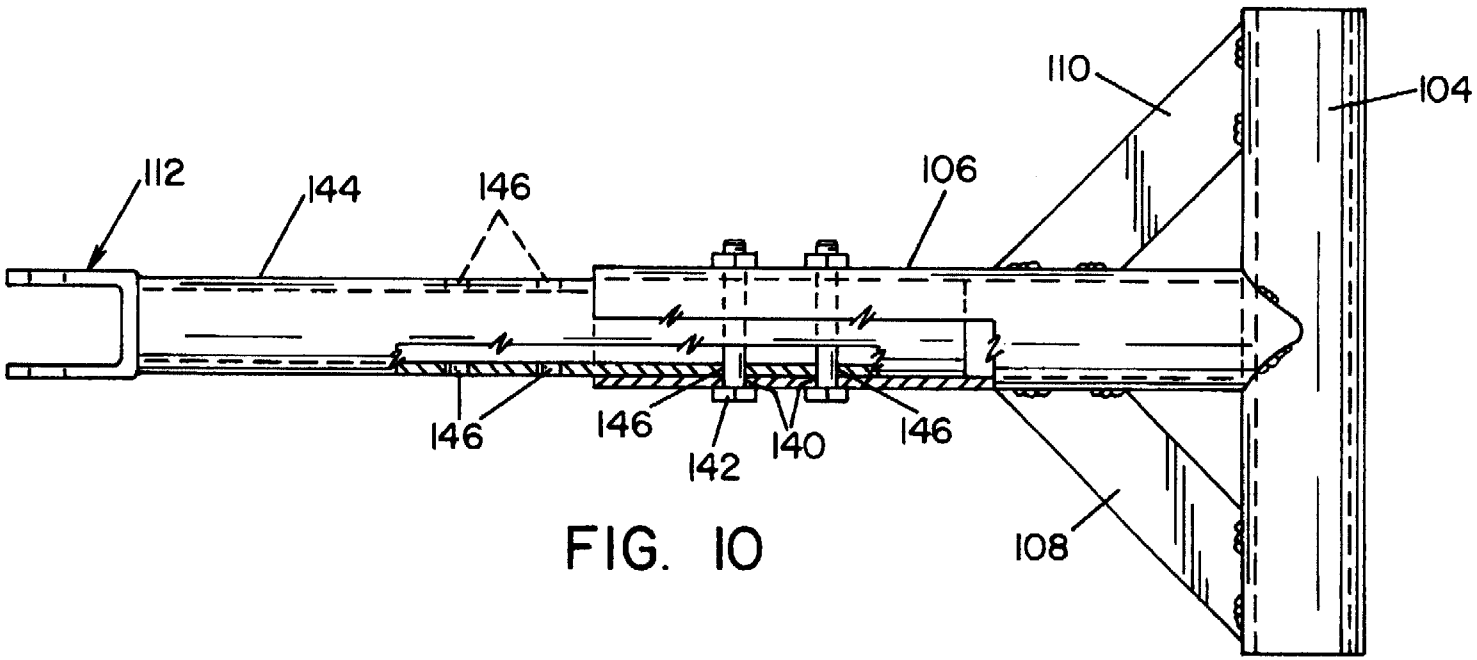
FIG. 10 is a plan view of another spacer embodiment in which the length of spacer is adjustable; and, FIG. 11 is a side elevational view of the spacer of FIG. 10 showing in an extended position in solid lines and in a compacted position in dashed lines.
Figure 11:
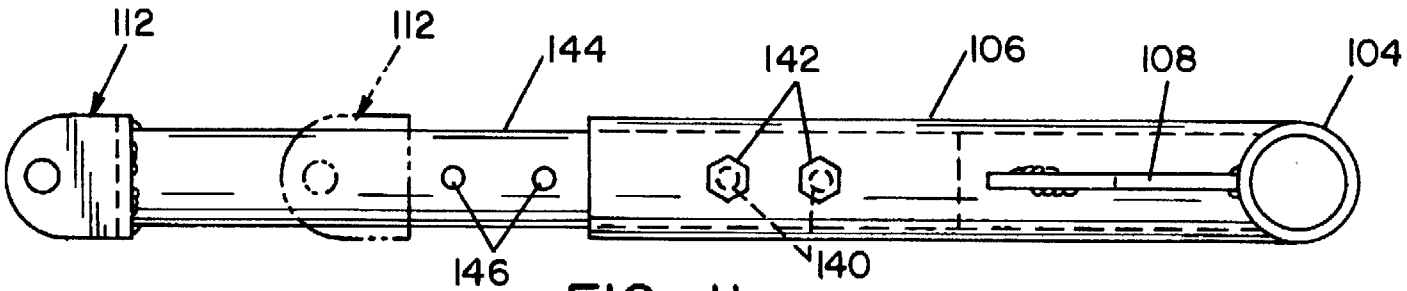

In a third embodiment, a pair of spacers 126 as shown in FIG. 7 are used. Spacers 126 are generally similar to the spacers of the second embodiment described above, but in this embodiment, the journal plates 100 are separated by a greater distance and rod 103 is correspondingly longer. The length of first tubular member 104 is significantly shorter than the distance between the journal plates in this embodiment. By using journal plates 100 spaced apart much further than the length of tubular member 104, the spacer is laterally adjustable to accommodate boats of different widths and thus, different distances between the pontoons thereof. If, for example, tubular member 104 is twelve inches shorter than the distance separating the journal plates, a system using two such spacers could be used with pontoon boats in which the pontoon spring varies by as much as two feet. In this embodiment, rod 103 includes a plurality of openings 128 adjacent the opposite ends thereof between plates 100 for receiving stops 130 to limit the lateral movement of the spacers once they have been positioned for use with a given pontoon boat. Stops 130 are preferably bolts which can be threaded into openings 128, but any suitable arrangement, such as pins slidably inserted through openings 128, could be used to limit the rod's lateral movement. An alternate method of fixing the lateral position of pipe 104 relative to rod 103 requires the provision of openings 129 in the wall of pipe 104 which can be aligned with openings 128 in rod 103. Stops 130 inserted through these aligned openings fix pipe 104 laterally with respect to the rod.

In a fourth embodiment, the mooring system comprises a first spacer 126 of the third embodiment and a second spacer 26 or 28 of the first or second embodiments. These combinations allow for lateral adjustability while providing one spacer which is relatively fixed. This would be useful, for example, where one of several pontoon boats was to be moored alongside of a single finger dock. The spacer 26 or 28, capable of limited lateral movement, could be placed closest to the finger dock while the laterally adjustable spacer 126 was placed further from the dock. In this manner, lateral adjustability is provided while spacer 26 or 28 cannot be moved significantly in a lateral direction to allow a pontoon or the boat frame to come in contact with the finger dock.

In a fifth embodiment shown in FIGS. 8–11, the spacer of the second embodiment can be modified so that the distance between dock 12 and U-shaped connector 112 can be varied to accommodate boats of different sizes. In this embodiment, second tubular member 106 includes a plurality of openings 140 in the sidewall thereof for receiving a fastening member 142 such as a bolt or a pin. A third tubular member 144 has an outer diameter slightly less than the inner diameter of first tubular member 106 and is slidingly received therewithin. Third member 144 includes a plurality of openings 146 corresponding to openings 140 in second member 106. Third member 144 can be fixed relative to second member 106 by passing one and preferably two fastening members 142 through the aligned openings 140, 146 in members 106, 144 respectively. U-shaped member 112 is attached to the end of third tubular member 144 in the same manner as it was attached to tubular member 106 in the second embodiment. In this manner, the distance between U-shaped member 112 and dock 10 can be increased or decreased as necessary by sliding tubular members 106, 140 with respect to one another and fixing the members relative to one another with fasteners 142, to accommodate pontoon boats of different sizes.

Referring now to FIG. 1, in operation, a pair of mooring spacers 26 are mounted on a dock 12 in a spaced-apart relationship next to a single finger dock 14 or between a pair of finger docks 14. A pontoon boat 10 is driven toward dock 12 until the ends 22 of pontoons 18 are near dock 12. Spacers 26 are then lowered so that fingers 58 and 64 of the spacers straddle the mooring eyes 20. Pins 78 are then placed through the openings in the fingers and through mooring eyes 20, where they are secured by spring clip pins 80 passing through openings 82 in pins 78. While the attachment of the spacers to the mooring eyes is accomplished in the preferred embodiment with the use of spring clip pins, pins 78 could also be secured by cotter pins or include a retractable button on one side thereof or use any of the other well known mechanisms for preventing a pin from being pulled back through an opening. Secured in this manner, pontoon boat 10 is free to rise and fall with the water which supports the boat but at the same time is prevented from coming into contact with dock 12 or finger docks 14.

Spacers 28 or 126 or a combination thereof according to one of the other preferred embodiments are used in the same manner, except that the laterally adjustable spacers 126 must be set to the required width for connection to a pontoon boat and stops 130 placed in holes 128 to laterally secure the spacers either before or after the spacers are connected to the pontoons. Likewise, spacers having a telescoping central portion must be adjusted prior to use. The spacers are lowered so that the fingers of U-shaped connectors 112 straddle the mooring eyes 20 and are secured with pins 78 and 80 in the same manner as the first embodiment.

The preferred embodiments described above may be used effectively with a variety of pontoon boats. When the mooring system is to be used only with a single pontoon boat, wherein adjustability is not needed, the first or second preferred embodiments may be most appropriate. When a large degree of adjustability is required, the system of the third preferred embodiment may be more effective. The degree of lateral adjustability required and the positioning of the spacers on the dock with respect to the boat will determine which of the preferred embodiments is best suited for a given application.

The invention has been described with reference to several preferred embodiments and it is apparent other embodiments as well as modifications of the preferred embodiments can be made without departing from the principles of the invention. One obvious modification to the above embodiments is the use of two spaced apart angle irons, one to support each of the bosses or each of the journal plates as described above. The use of separate angle irons in this manner reduces the overall weight of the product while not compromising the performance of the system. Accordingly, it will be distinctly understood that the foregoing descriptive matter is to be interpreted merely as illustrative of the invention and not as a limitation thereof.

I claim:

1. A pontoon boat mooring system for mooring a pontoon boat having first and second pontoons to a dock wherein each of said pontoons includes a top surface and mooring means mounted on said top surface., said system comprising: first and second rigid spacing means for spacing the first and second pontoons of the pontoon boat from the dock, mounting means for mounting said first and second spacing means on said dock, and securement means extending from said spacing means and pivotal therewith in a vertical plane to contact said top surface proximate said mooring means for securing said first and second spacing means to said mooring means on the first and second pontoons of the pontoon boat.

2. The mooring system of claim 1, wherein said mounting means is proximate to an edge of the dock and said first and said second spacing means are pivotable about an axis parallel to said edge of said dock.

3. The mooring system of claim 2, wherein said first and said second rigid spacing means are pivotably attached to said mounting means.

4. The mooring system of claim 3, wherein said securement means includes finger means on each said first and second spacing means for connection with the corresponding one of said mooring means.

5. The mooring system of claim 4, wherein said mooring means comprises a first and a second mooring eye fixedly secured respectively to said first and said second pontoons.

6. The moo ring system of claim 5, wherein said securement means further includes pin means for securing each said mooring eye to the corresponding one of said finger means.

7. The mooring system of claim 2, wherein each said first and said second spacing means comprises a rigid frame having leg portions for connection to said mounting means.

8. A pontoon boat mooring system for mooring a pontoon boat having first and second pontoons to a dock wherein each of said pontoons includes mooring means, said system comprising: first and second rigid spacing means for spacing the first and second pontoons of the pontoon boat from the dock, mounting means proximate to an edge of the dock for mounting said first and second spacing means on said dock, and securement means for securing said first and second spacing means to said mooring means on the first and second pontoons of the pontoon boat, wherein said spacing means comprises a rigid frame pivotable about an axis parallel to the edge of said dock and having leg portions for connection to said mounting means, and first and second side rails connected by first and second transverse braces generally parallel to the edge of said dock.

9. The mooring system of claim 8, wherein said first and second leg portions are parallel to one another and said first and second rail portions converge toward one another between and in the direction from said first transverse brace toward said second transverse brace.

10. The mooring system of claim 9, wherein said mounting means comprises plate means fixedly secured to said dock and wherein said plate means includes first and second boss means for attachment to said leg portions of said rigid frame.

11. The mounting system of claim 10, wherein said mounting means comprises an angle iron member having a first plate portion overlying a top surface of said dock and a second plate portion overlying a side surface of said dock.

12. The mounting system of claim 10, wherein said securement means comprises first and second spaced-apart finger portions for receiving said mooring means therebetween, said finger portions having an opening therethrough, and pin means for passing through said first and second finger portions and said mooring means for securing said mooring means to said securement means.

13. The mooring system of claim 2, wherein said mounting means includes means mounting at least one of said first and said second spacing means on said dock for lateral adjustment of the position of said one spacing means relative to said dock.

14. The mooring system of claim 13, wherein said mounting means includes first and second journal plates for supporting said one of said spacing means.

15. The mooring system of claim 14, wherein said one of said first and said second spacing means comprises a rod supported between said first and second journal plates and having an axis parallel to said edge of said dock.

16. The mooring system of claim 15 including a first pipe mounted on said rod for rotation relative thereto about said axis.

17. The mooring system of claim 16, wherein said one of said first and second spacing means further includes a second pipe extending perpendicularly from said first pipe, a first brace attached to said first pipe between said first journal plate and said second pipe and connected to said second pipe, and a second brace attached to said first pipe between said second pipe and said second journal plate and connected to said second pipe.

18. The mooring system of claim 17, wherein said first pipe is laterally slidable on said rod between said journal plates, and means for selectively holding said first pipe in one of a plurality of positions on said rod between said journal plates relative to said dock.

19. The mooring system of claim 18, wherein said means for holding said first pipe comprises pin means on said rod.

20. The mooring system of claim 13, including stop means for laterally holding said one spacing means in an adjusted position relative to said dock.

21. A pontoon boat mooring system for mooring a pontoon boat having first and second pontoons to a dock wherein each of said pontoons includes mooring means, said system comprising: first and second rigid spacing means for spacing the first and second pontoons of the pontoon boat from the dock, mounting means comprising first and second journal plates for mounting said first and second spacing means on said dock, and securement means for securing said first and second spacing means to said mooring means on the first and second pontoons of the pontoon boat, wherein said spacing means comprises a rod member supported by said journal plates and a first pipe member supported on said rod member between said journal plates.

22. The mooring system of claim 21, further including a second pipe member perpendicular and connected to said first pipe member.

23. The mooring system of claim 22, further including a U-shaped connector member attached to said second pipe member, and pin means for attaching said U-shaped member to said mooring means.

24. The mooring system of claim 23, wherein said U-shaped connector member includes a first finger and a second finger and wherein said connector is mounted such that said fingers are parallel to said second pipe member.

25. The mooring system of claim 24, wherein said U-shaped connector member includes a first finger and a second finger and wherein said connector is mounted such that said fingers are perpendicular to said second pipe member.

26. The mooring system of claim 21, wherein said first pipe member is shorter than the distance separating said journal plates and is rotatable relative to said rod member.

27. The mooring system of sighed 23, further including brace means for bracing said second pipe with respect to said first pipe.

28. The mooring system of claim 21, further including a second pipe member extending perpendicularly from said first pipe member and a third pipe member slidingly received in said second pipe member.

29. The mooring system of claim 28, including a U-shaped connector member attached to said third pipe member and pin means for attached said U-shaped member to said mooring means.

30. The mooring system of claim 28, wherein said second pipe member includes a plurality of openings in the sidewall thereof, said third pipe member includes a plurality of openings in the sidewall thereof, and including fastening means for passing through said openings in said third pipe member for securing said second pipe member relative to said third pipe member.

31. A mooring system for connecting first and second mooring means on a pontoon boat to a dock having an edge comprising:

first and second mounting means each comprising plate means for mounting on a dock and a pair of spaced apart apertured bosses mounted on and extending from said plate means at a right angle;

first and second rigid spacing means respectively for said first and second mounting means and each including a pair of leg portions, a pair of central rail portions and a pair of terminal finger portions, said leg portions being pivotally connected to said pair of bosses of the corresponding one of said first and second mounting means by pins for pivotable movement about an axis parallel to said dock, said central rail portions extending from said leg portions in the direction away from said dock, and said terminal finger portions extending from said central rail portions in said direction and including openings therethrough; and, connector means for connecting said terminal finger portions of said first and second rigid spacing means respectively to said first and second mooring means.

32. The mooring system of claim 31, wherein said pair of leg portions are parallel.

33. The mooring system of claim 32, wherein said pair of finger portions are parallel.

34. The mooring system of claim 33, wherein said pair of central rail portions converge toward one another in said direction.

35. A mooring system for connecting first and second mooring means on a pontoon boat to a dock having an edge comprising:

first and second mounting means each comprising mounting plate means for mounting on a dock and including first and second journal plates having openings therethrough and extending from said mounting plate means at a right angle;

first and second rigid spacing means respectively for said first and second mounting means and each comprising a rod member having a longitudinal axis, said rod member being mounted in said openings through the first and second journal plates of the corresponding one of said first and second mounting means for rotation about said axis, first pipe means surrounding and rotatable relative to said rod member, second pipe means attached to said first pipe means at a right angle, braces extending between said first pipe means and said second pipe means on opposite sides of said second pipe means; and securement means on said second pipe means for connecting said first and second spacing means respectively to said first and second mooring means.

36. The mooring system of claim 35, wherein said first pipe means is laterally moveable with respect to said rod member.

37. The mooring system of claim 36, wherein said first pipe means is substantially shorter than the distance separating said journal plates.

38. The mooring system of claim 37, including stop means for limiting lateral movement of said pipe relative to said rod member.

39. The mooring system of claim 38, wherein said stop means comprises a plurality of openings in said rod member and stop members receivable in said openings.

40. The mooring system of claim 38, wherein said stop means includes a plurality of openings in said first pipe member and stop members receivable in said pipe openings and said rod openings to secure said first pipe relative to said rod member.

41. The mooring system of claim 35, wherein said first and second mounting plate means each comprises an angle iron mounted on the edge of said dock.

42. The mooring system of claim 41, wherein said securement means comprises a U-shaped member having first and second finger portions, and pin means for connecting said first and second finger portions respectively to said first and second mooring means.

43. The mooring system of claim 42, wherein said finger portions are parallel to said second pipe.

44. The mooring system of claim 43, wherein said finger portions are perpendicular to said second pipe.

45. The mooring system of claim 37, including first and second end pins extending through said rod member adjacent each of said journal plates for retaining said rod member on said journal plates.

* * * * *